United States Patent [19]

Schoenfield

[11] 4,054,191

[45] Oct. 18, 1977

[54] CARRYING CASE FOR TOYS, DOLLS, OR THE LIKE

[75] Inventor: Palmer J. Schoenfield, Evanston, Ill.

[73] Assignee: Marvin Glass & Associates, Chicago, Ill.

[21] Appl. No.: 634,370

[22] Filed: Nov. 24, 1975

[51] Int. Cl.[2] ..... A45C 3/00

[52] U.S. Cl. ..... 190/41 R; 190/51

[58] Field of Search ..... 229/37, 38, 39; 190/1, 190/41 R, 48, 41 C, 41 B, 51

[56] References Cited

U.S. PATENT DOCUMENTS

| | | | |
|---|---|---|---|
| 2,636,662 | 4/1953 | Diehl | 190/41 R |
| 3,552,466 | 1/1971 | Fairchilds | 190/41 R |
| D. 189,868 | 3/1961 | Casselman | 190/41 R |

FOREIGN PATENT DOCUMENTS

| | | | |
|---|---|---|---|
| 1,254,022 | 1/1961 | France | 190/41 B |
| 327,957 | 4/1930 | United Kingdom | 190/41 B |

*Primary Examiner*—R. E. Hart
*Attorney, Agent, or Firm*—Mason, Kolehmainen, Rathburn & Wyss

[57] ABSTRACT

A carrying case fabricated of sheet material which includes a box-like rear compartment having an open front defined partially by a pair of generally parallel vertical side edges. A pair of box-like front compartments each have an open side defined partially by a generally vertical edge hinged to one of the edges of the rear compartment. Each front compartment is approximately one-half the size of said rear compartment and is pivotable about the hinged edge between a closed position closing the open front of the rear compartment and an open position whereat the interior of all three compartments are exposed. A handle is provided on the top front edge of the rear compartment.

14 Claims, 6 Drawing Figures

CARRYING CASE FOR TOYS, DOLLS, OR THE LIKE

BACKGROUND AND SUMMARY OF THE INVENTION

This invention relates to a novel carrying case fabricated of sheet material. Carrying cases have been provided for toys, dolls, or the like, in which the case not only provides means for carrying and storing the toys, but the carrying case when in open position provides a certain atmosphere related to the toys utilized therewith. This invention is directed to providing a new and improved carrying case of the character described which is readily adapted for use with toys and dolls.

More particularly, the carrying case is generally hexagonal in horizontal cross section and includes a rear compartment which is trapezoidal in cross section to form three sides of the carrying case. The rear compartment has an open front defined partially by a pair of generally parallel vertical side edges. A pair of box-like front compartments are provided and are trapezoidal in cross section to form the remaining three sides of the carrying case. The front compartments each have an open side defined partially by a generally vertical edge hinged to one of the vertical edges of the rear compartment. Each of the front compartments is approximately one-half the size of the rear compartment and is pivotable about the hinged edge between a closed position closing the open front of the rear compartment and an open position whereat the interior of all three compartments are exposed. A handle is provided at the front edge of the rear compartment on a supporting brace extending therealong. The supporting brace includes a forwardly facing slot within which the top front edges of the front compartments are positionable when in their closed position. A latch means in the form of a flexible flap is secured to one of the front compartments and is releasably securable to the other of the front compartments. The one front compartment to which the flexible flap is secured includes a door portion to which the flap is secured for opening the door portion when the flap is released from the other front compartment.

A foldable floor is connected to the bottom edges of the three compartments and is foldably movable into the interior of the carrying case when the two front compartments are moved to their closed positions.

Each of the three compartments are fabricated from a blank of rigidifying sheet material, such as cardboard, having fold lines provided thereon to form the shape of each compartment. The fold lines are defined by slots in the rigidifying sheet material. The three blanks are connected together by a pair of plastic sheets conforming to the shape of the blanks when in position for assembly, sandwiching the blanks therebetween, with the plastic sheets sealed through the slots to hold the blanks in position for assembly.

Other objects, features and advantages of the invention will be apparent from the following detailed description taken in connection with the accompanying drawings.

DETAILED DESCRIPTION OF THE PREFERRED EMBODIMENT

Figure 4:
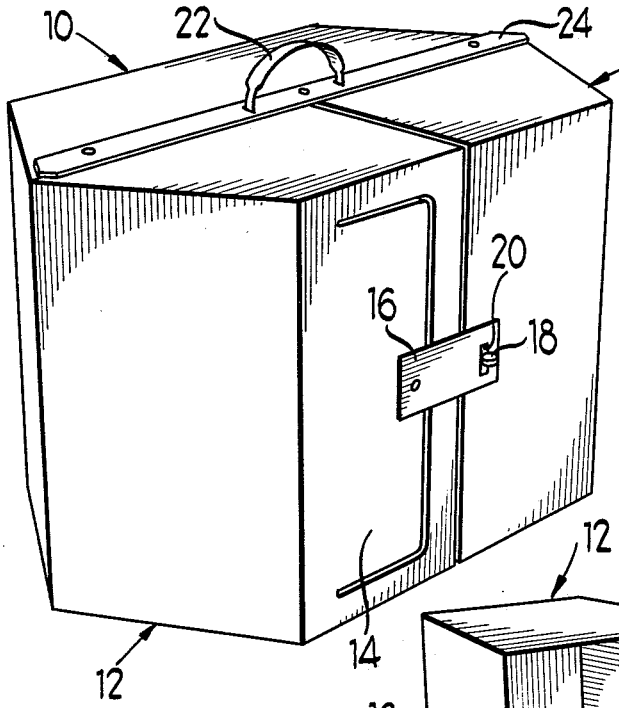
FIG. 4 is a perspective view of the carrying case in closed position.
Figure 5:
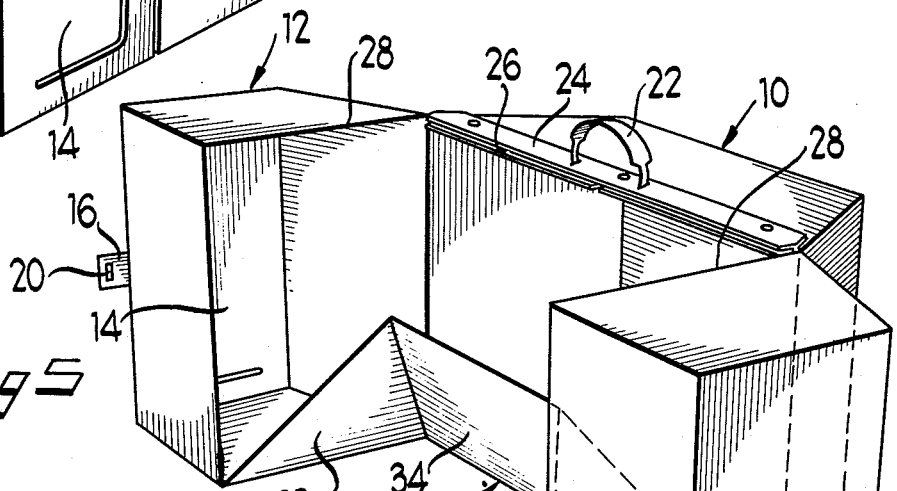
FIG. 5 is a perspective view of the carrying case partially open to illustrate the unfolding of the floor portion of the carrying case.
Figure 6:
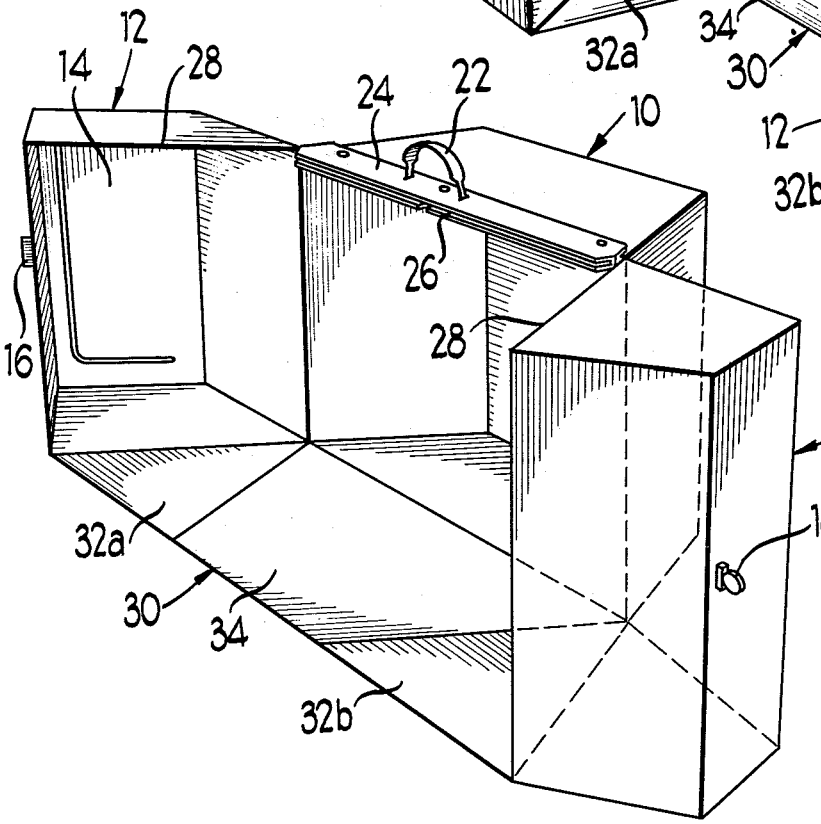
FIG. 6 is a perspective view of the carrying case in fully open position.

Referring to FIG. 4, the carrying case of the present invention includes a rear compartment, generally designated 10, and a pair of front compartments, generally designated 12, each of which are approximately one-half the size of the rear compartment 10 so as to form a hexagonal carrying case in horizontal cross section. Each of the compartments are trapezoidal with the front compartments 12, when in closed position as shown in FIG. 4, being a substantial mirror image of the rear compartment 10. The lefthand front compartment 12 shown in FIG. 4 has a door 14 to which a latch flap 16 is secured. The flap 16 is releasably securable to the righthand front compartment 12 by a rotatable tab 18 positionable in a slot 20 in the flap 16. A U-shaped handle 22 is secured to a reinforcing cross brace 24 secured along the front top edge of the rear compartment 10. As seen in FIGS. 5 and 6 the front edge of the brace 24 is provided with a longitudinal slot 26 within which the rear top edges 28 of the front compartments 12 are positionable when in closed position so as to support the same from callapsing.

Again referring to FIGS. 5 and 6, a floor, generally designated 30, is provided for the carrying case when in its fully open position as seen in FIG. 6. The floor comprises a pair of left and righthand triangular portions 32a and 32b, respectively, which are hinged to a central trapezoidal portion 34 so that the floor is foldable to a collapsed position within the interior of the carrying case when in closed position as shown by the intermediate position shown in FIG. 5.

Figure 1:
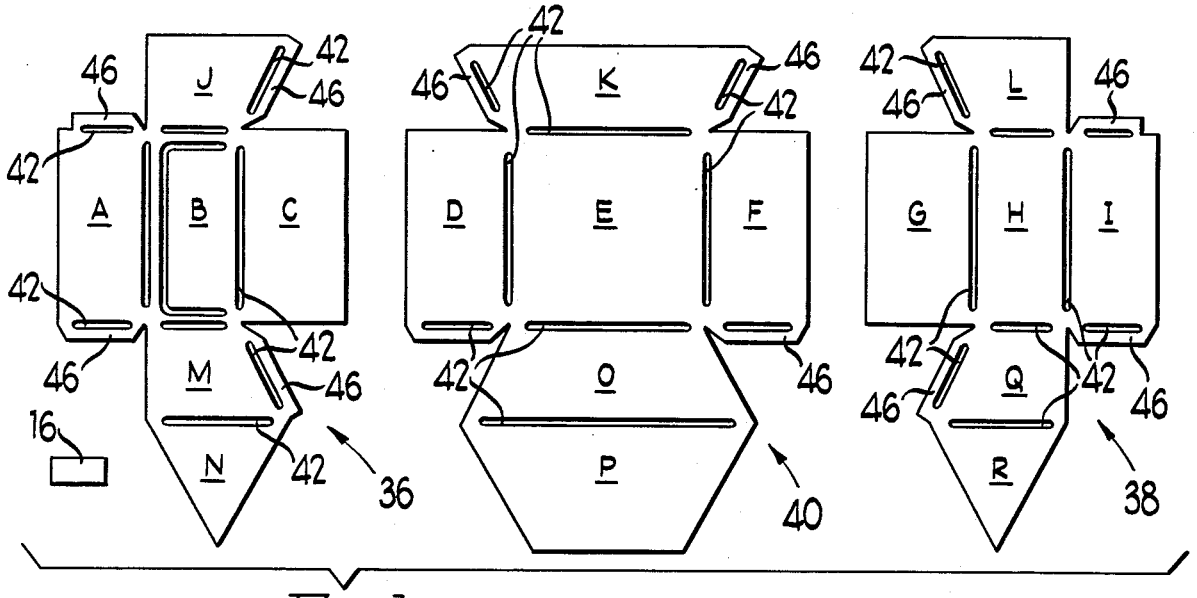
FIG. 1 is a perspective view of the three sheet material blanks which form the compartments of the carrying case of the present invention, along with a blank for the latch flap therefor.
Figure 2:
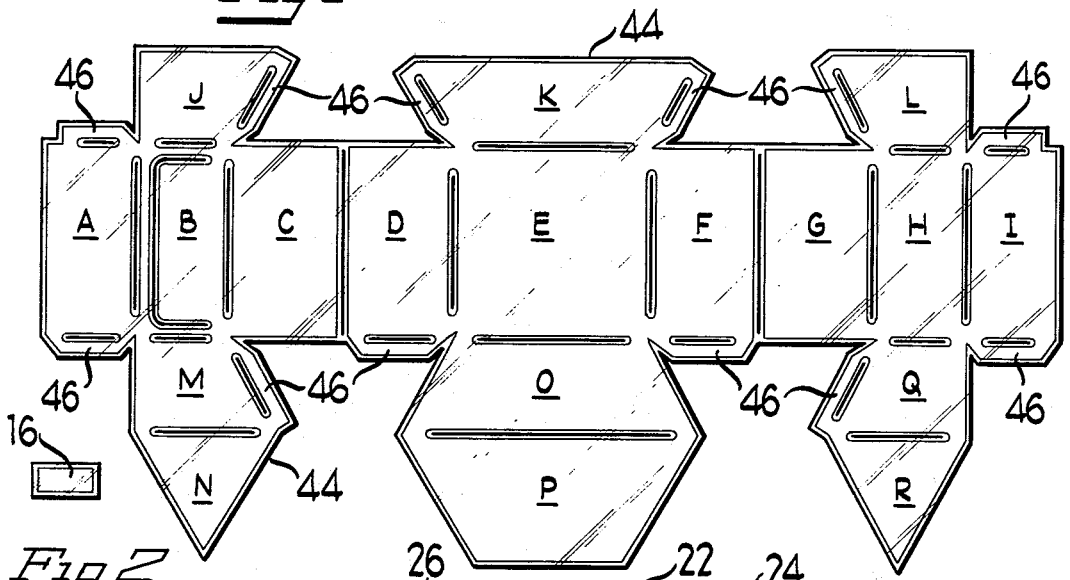
FIG. 2 is a view to that of FIG. 1 with the blanks connected together by means of a pair of sheets of plastic material sandwiching the blanks therebetween.
Figure 3:
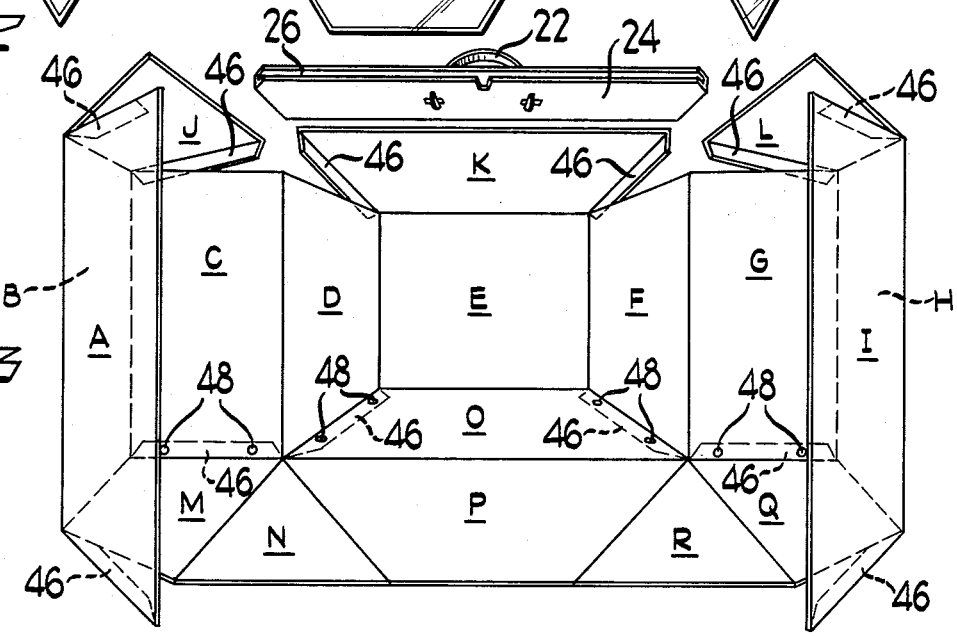
FIG. 3 is a front perspective view illustrating the manner in which the composite structure of FIG. 2 is folded to form the carrying case of the present invention.

Referring now to FIGS. 1 through 3, the method of fabricating the carrying case will be described, and most of the numerals used to designate the various compartments, etc. in FIGS. 4–6 will not be repeated, but alphabetical references will be applied to the various sheet material components of the carrying case.

More particularly, referring to FIG. 1, three separate blanks are formed sheet material such as cardboard to form the three separate compartments 10, 12. The lefthand blank in FIG. 1, generally designated 36, is used to form the lefthand compartment 12 in FIGS. 4–5. Correspondingly, the righthand blank 38 shown in FIG. 1 is utilized to form the righthand compartment of the carrying case. A central blank, generally designated 40 in FIG. 1, is utilized to form the rear compartment 10 of the carrying case. A plurality of fold lines are formed on the blanks by means of slots 42 cut into the sheet material at the desired positions where the blanks are to be folded to form the carrying case. Throughout FIGS. 1–3, alphabetical references are applied to each section between the slotted fold lines 42 which correspond to the different panels of the carrying case as shown in FIG. 3. So as not to belabor the descriptiion, reference will be made solely to the central blank 40 as it progresses from FIG. 1 to the assembled case shown in FIG. 3. It can be seen that the panel K forms the top wall of the rear compartment 10. The panel E forms the rear wall of the rear compartment. The panel O forms the bottom wall of the rear compartment. The panel D forms the lefthand side wall of the rear compartment. The panel F forms the righthand side wall of the rear compartment. The panel P which is connected to the bottom wall O of the rear compartment is folded so as to form the central portion 34 of the floor of the case when in open position as seen in FIG. 6. The corresponding alphabetical references can be followed thoughout FIGS. 1 through 3. As seen in the lefthand bottom of FIG. 1, a blank is cut from the sheet material to form the latch flap 16.

After the blanks 36, 38 and 40 are cut from the sheet material, they are placed adjacent each other as shown in FIG. 2 and plastic transparent sheet material is placed on opposite sides of the adjoining blanks and are sealed about the blanks, as at 44 and are also sealed through the slots 42 to reinforce the fold lines defined thereby.

In addition, connecting flaps 46 are defined by fold lines from slot 42 at positions about the blanks so as to form connecting (see FIG. 3) to secure the casing in assembled position, as by rivets 48 (FIG. 3).

FIG. 3 shows the various foldable oreientations of the fold lines defined by the plastic sealed slots 42 so as to fabricate the carrying case into the configuration shown in FIGS. 4–6.

The sheet material forming the blanks 36, 38 and 40 can have appropriate decorations thereon visible through the transparent plastic sheet material and protected thereby so that when the carrying case is either in its closed or open position a particular environment, such as an abode, can be represented by the carrying case for correlation with the particular toys or dolls to be utilized therewith.

The foregoing detailed description has been given for clearness of understanding only and no unnecessary limitations should be understood therefrom as some modifications will be obvious to those skilled in the art.

I claim:

1. A carrying case fabricated of sheet meterial, comprising:

a box-like rear compartment having an open front defined partially by a pair of generally parallel vertical side edges;

a pair of box-like front compartments each having an open side defined partially by a generally vertical edge hinged to one of the vertical edges of said rear compartment, each of said front compartments being approximately one-half the size of said rear compartment and pivotable about said hinged edge between a closed position closing the open front of said rear compartment and an open position whereat the interior of all three compartments are exposed; and handle means on the top of the carrying case for carrying the same.

2. The carrying case of claim 1 including latch means for holding said pair of front compartments in said closed position against the front of said rear compartment.

3. The carrying case of claim 1 wherein each of said three compartments are fabricated from a blank of rigidifying sheet material fold lines provided thereon to form the shape of each compartment and including connecting means between the blanks.

4. The carrying case of claim 3 wherein said connecting means comprises a continuous sheet of plastic material overlying and fixed to said blanks to maintain the relative positions thereof.

5. The carrying case of claim 3 wherein said connecting means comprises a pair of plastic sheets conforming to the shape of said blanks when in position for assembly, sandwiching the blanks therebetween, said plastic sheets being sealed through the slots to hold the blanks in position for assembly.

6. The carrying case of claim 5 wherein the fold lines are defined by slots in the rigidifying sheet material with said plastic being sealed together through the slots.

7. The carrying case of claim 1 including a foldable floor connected to the bottom edge of said three compartments and foldably movable into the interior of the carrying case when said two front compartments are moved to said closed position.

8. The carrying case of claim 1 including a supporting brace across the front top edge of said box-like rear compartment, with said handle means secured to the top thereof.

9. The carrying case of claim 8 wherein said brace includes a forwardly facing slot within which the top front edges of said front compartments are positionable when in their closed position.

10. The carrying case of claim 8 wherein said handle means comprises an upwardly arced U-shaped member secured to the top of said brace.

11. The carrying case of claim 1 including latch means between said pair of front compartments to hold said compartments in said closed position, said latch means including a flexible flap secured to one of said front compartments and releasably securable to the other of said front compartments.

12. The carrying case of claim 11 wherein the one front compartment to which said flexible flap is secured includes a door portion to which the flap is secured for opening the door portion when the flap is released from the other front compartment.

13. The carrying case of claim 1 wherein the case is hexagonal in horizontal cross section when in closed position and each of said compartments is trapezoidal in horizontal cross section whereby the rear compartment forms three sides of the case and the front compartments form the other three sides of the case.

14. The carrying case of claim 13 where both the top and bottom of the carrying case are flat with the respective tops and bottoms of said compartments being generally coplanar.

* * * * *

UNITED STATES PATENT AND TRADEMARK OFFICE

CERTIFICATE OF CORRECTION

PATENT NO. : 4,054,191

DATED : October 18th, 1977

INVENTOR(S) : Palmer J. Schoenfield

It is certified that error appears in the above-identified patent and that said Letters Patent are hereby corrected as shown below:

Column 1, line 32, after "front" insert --top--.
Column 2, line 38, "callapsing" should be --collapsing--.
Column 2, line 1, after "is a" insert --similar--.
Column 2, line 55, after "formed" insert --from--.
Column 3, line 2, "descriptiion" should be --description--.

Column 3, line 28, after "connecting" insert --means--.
Column 3, line 30, "oreientations" should be --orientations--.

Claim 1, line 1 "meterial" should be --material--.
Claim 3, line 3, after "material" insert --having--.
Claim 6, line 3, after "plastic" insert --sheets--.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*